US006010209A

United States Patent [19]

Kitahara

[11] Patent Number: 6,010,209

[45] Date of Patent: Jan. 4, 2000

[54] PASSAGE FORMING SUBSTRATE FOR AN INK-JET RECORDING HEAD

[75] Inventor: Tsuyoshi Kitahara, Nagano, Japan

[73] Assignee: Seiko Epson Corporation, Tokyo, Japan

[21] Appl. No.: 09/013,222

[22] Filed: Jan. 26, 1998

[30] Foreign Application Priority Data

Jan. 24, 1997 [JP] Japan ..... 9-26075
Dec. 16, 1997 [JP] Japan ..... 9-363649

[51] Int. Cl.[7] ..... B41J 2/045

[52] U.S. Cl. ..... 347/71

[58] Field of Search ..... 347/40, 43, 65, 347/70, 71

[56] References Cited

U.S. PATENT DOCUMENTS

| | | | |
|---|---|---|---|
| 5,659,346 | 8/1997 | Moynihan et al. | 347/70 X |
| 5,748,214 | 5/1998 | Usui et al. | 347/70 |
| 5,880,763 | 3/1999 | Tanaka et al. | 347/70 |
| 5,907,340 | 5/1999 | Katakura et al. | 347/71 |

FOREIGN PATENT DOCUMENTS

| | | |
|---|---|---|
| 0 726 151 | 8/1996 | European Pat. Off. . |
| 0 897 801 | 2/1999 | European Pat. Off. . |

OTHER PUBLICATIONS

Patent Abstracts of Japan vol. 011 No. 021 (M–55), Jan. 21, 1987 & JP 61 193859 A (Nec Corp) Aug. 28, 1986.

Patent Abstracts of Japan vol. 006, No. 267 (M–182), Dec. 25, 1982 & JP 57 159658 A (Fujitsu KK) Oct. 1, 1982.

Patent Abstracts of Japan vol. 012, No. 428 (M–762) Nov. 11, 1988 *JP 63 162252 A (Nec Corp) Jul. 5, 1988 Abstract.

Patent Abstracts of Japan vol. 012, No. 305 (M–733) Aug. 19, 1988 & JP 63 081049 A (Nec Corp) Apr. 11, 1988 Abstract.

Patent Abstracts of Japan vol. 016, No. 563 (M–1342), Dec. 4, 1992 & JP 04 216939 A (Seiko Epson Corp) Aug. 7, 1992 Abstract.

*Primary Examiner*—William J. Royer
*Attorney, Agent, or Firm*—Sughrue, Mion, Zinn Macpeak & Seas, PLLC

[57] ABSTRACT

An ink-jet recording head which is operative to efficiently remove air bubbles from the pressure generating chambers and efficiently supply ink to the pressure generating chambers. First pressure generating chambers and second pressure generating chambers which communicate with a reservoir through first ink supply ports and second ink supply ports, and communicate with each other through ink supplying passages, are formed on both sides of a passage forming substrate. The first ink supply ports are formed on one side of the passage forming substrate that contains a discharge orifice, and the second ink supply ports are formed on the other side of the passage forming substrate that faces an elastic plate. A flow resistance of each of the second ink supply ports is larger than that of each of the first ink supply ports, whereby ink also flows into the second pressure generating chambers located closer to a nozzle plate through the ink supplying passages. With such a structure, air bubbles remaining in the first pressure generating chambers, which are formed on the surface of the ink passage forming substrate that faces a piezoelectric transducing element, easily move to the second pressure generating chambers located closer to the discharge orifice which serves as an ink discharging port, and can readily be discharged out of the recording head at the time of maintenance.

18 Claims, 6 Drawing Sheets

FIG. 3 (II)

FIG. 3 (III)

FIG. 3 (IV)

FIG. 4 (I')
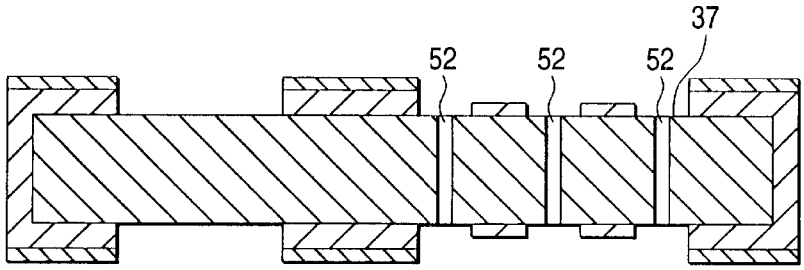
FIG. 4 (I)
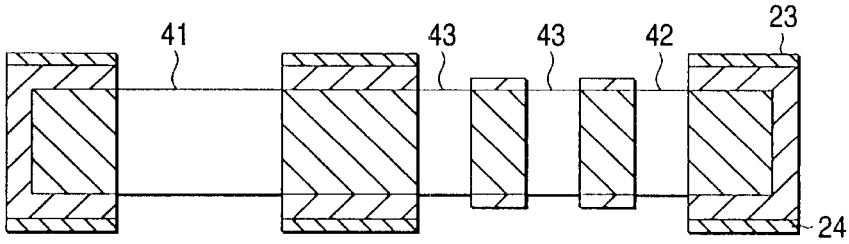
FIG. 4 (II)
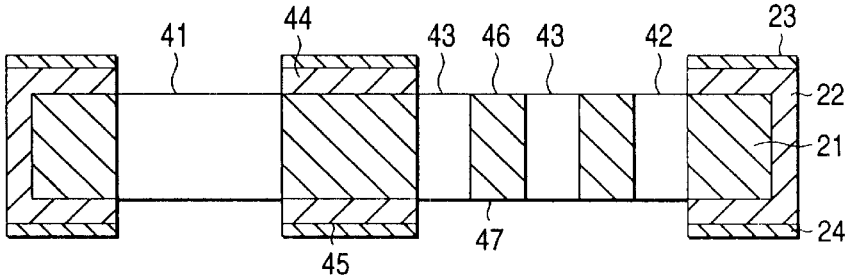
FIG. 4 (III)
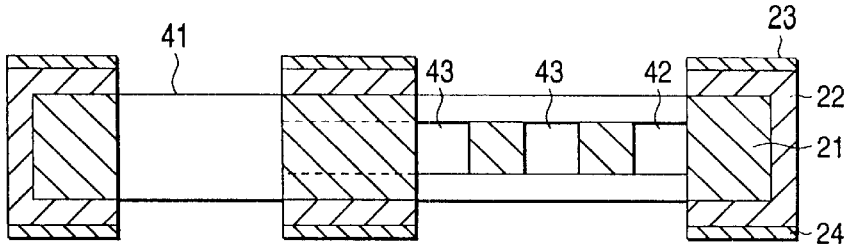

FIG. 5 (II)

PASSAGE FORMING SUBSTRATE FOR AN INK-JET RECORDING HEAD

BACKGROUND OF THE INVENTION

1. Field of the Invention

The present invention relates to an ink-jet recording head in which a pressure generating chamber ejects ink in the form of ink droplets or drops by utilization of elastic deformations of an elastic plate as a part of the pressure generating chamber, which are caused by a piezoelectric transducing element. More particularly, the invention relates to the structure of a passage forming substrate.

2. Description of the Related Art

The ink-jet recording head (referred often to as a printhead) includes an ink passage unit. The ink passage unit is composed of a reservoir for receiving ink from an ink tank externally provided, pressure generating chambers formed as cavities to which pressure is applied, ink supply ports each communicatively connecting a reservoir with a pressure generating chamber, a passage forming substrate having nozzle passage holes formed as through-holes each communicated with a pressure generating chamber and a discharge orifice, an elastic plate being sealingly applied to one of the major surfaces of the passage forming substrate, a nozzle plate with discharge orifices being sealingly applied to the other major surface of the passage forming substrate, and piezoelectric transducing elements are provided on the elastic plate. A pressure generating chamber is expanded and contracted by utilization of displacement of a piezoelectric transducing element associated with the pressure generating chamber. When the pressure generating chamber is expanded, the pressure generating chamber sucks ink from a reservoir associated therewith, through an ink supply port also associated therewith. When contracted, the pressure generating chamber pressurizes ink contained therein to forcibly discharge the ink in the form of an ink drop, through the discharge orifice associated therewith.

When color inks are used, the ink-jet printhead is capable of performing a full color printing. Because of this feature, the printhead is used for a color printer and its use has rapidly become widespread. In this respect, there is a consistent demand of further improvement of the quality of the print by the ink-jet printhead.

The print quality of this type of printhead depends largely on the size of dots formed by the ink drops ejected from the printhead and a print density of the print by the printhead. To increase the print density, it is essential to reduce the volume of one ink drop as small as possible, viz., the size of the dot formed by it.

To this end, the necessity is to array pressure generating chambers at the highest density and to substantially prevent or minimize a deformation of the passage forming substrate. Further, for ease of handling in assembling the printhead, it is necessary to reduce the volume of each pressure generating chamber and to array the chambers at high density. In connection with this, Japanese Patent Laid-Open Publication No. Sho-58-40509 discloses such a novel technique in that a silicon monocrystalline substrate having a face is lithographically and anisotropically processed to form therein recesses being shallow in depth and small in their opening area, and the recesses are used as pressure generating chambers or cavities while being densely arrayed.

Each pressure generating chamber thus formed is flat. The flat pressure generating chamber is large in its flow resistance. A smoothness of the supplying of ink from the reservoir to the pressure generating chamber is lost. A possible measure to address this problem is to enlarge the ink supplying passages without increasing the volume on the ink drop, specifically to additionally provide second pressure generating chambers in the part of the silicon monocrystalline substrate, located on the opposite side from the side where the piezoelectric transducing elements are formed, viz., the part where the discharge orifices are formed. This measure suffers from another problem, however. That is, a velocity of flow of the ink flowing from the reservoir to the pressure generating chamber is decreased. Where the flow velocity of ink is low, bubbles tend to remain in the pressure generating chambers located closer to the piezoelectric transducing elements. The result is to deteriorate a quality of the resultant print.

SUMMARY OF THE INVENTION

Accordingly, an object of the present invention is to provide an ink-jet recording head which ensures a smooth supply of ink from the reservoir to the pressure generating chambers and eliminates the stagnation of air bubbles in the pressure generating chambers.

To solve the above problems, there is provided an ink-jet recording head having 1) a passage forming substrate which defines pressure generating chambers and contains a reservoir, ink supply ports, and nozzle passages as through-holes, 2) a nozzle plate having a nozzle orifice communicating with the pressure generating chambers through the nozzle passages, 3) an elastic plate sealingly covering one of the surfaces of the passage forming substrate, and 4) a pressure generating device which pressurizes the pressure generating chambers, the ink-jet recording head comprising: first ink supply ports formed on the one surface of the passage forming substrate which faces the elastic plate; second ink supply ports formed on another of the surfaces of the passage forming substrate which faces the nozzle plate; and first and second pressure generating chambers communicating with the reservoir through the first and second ink supply ports; wherein a flow resistance of each of the first ink supply ports is smaller than that of each of the second ink supply ports.

With such a structure, air bubbles remaining in the first pressure generating chambers, which are formed on the surface of the ink passage forming substrate that faces a piezoelectric transducing element, easily move to the second pressure generating chambers located closer to the discharge orifice serving as an ink discharging port, and can readily be discharged out of the recording head at the time of maintenance where the discharge orifice is placed under an externally applied negative pressure.

BRIEF DESCRIPTION OF THE DRAWINGS

FIGS. 3(I), 3(II), 3(III) and 3(IV) are sectional views showing a sequence of steps of a method for manufacturing a passage forming substrate, which constitutes an embodiment of the present invention, necessary through-holes being formed through the sequence of the manufacturing steps;

FIGS. 4(I'), 4(I), 4(II) and 4(III) are sectional views showing another sequence of steps of the manufacturing method, which follows a step of forming etching guide through-holes;

FIGS. 5(I) and 5(II) are sectional views showing another method of manufacturing a passage forming substrate, which constitutes another embodiment of the present invention.

DETAILED DESCRIPTION OF THE PREFERRED EMBODIMENTS

A detailed description of the preferred embodiments of the present invention will now be given with reference to the accompanying drawings.

Figure 1:
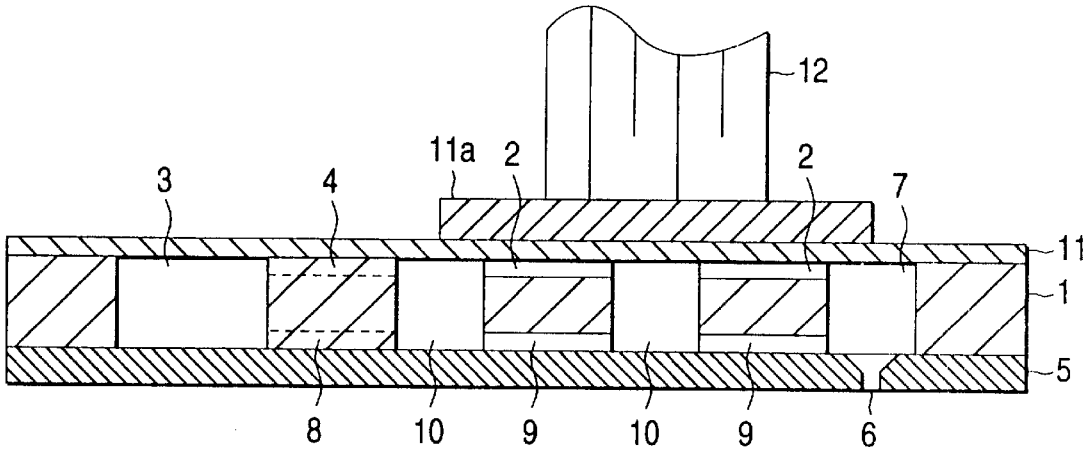
FIGS. 1(A) and 1(B) are sectional views showing a structure of an ink-jet recording head constructed according to the present invention, the structure being illustrated while being cut along the center line of juxtaposed pressure generating chambers contained therein, and flows of ink therein.
Figure 1:
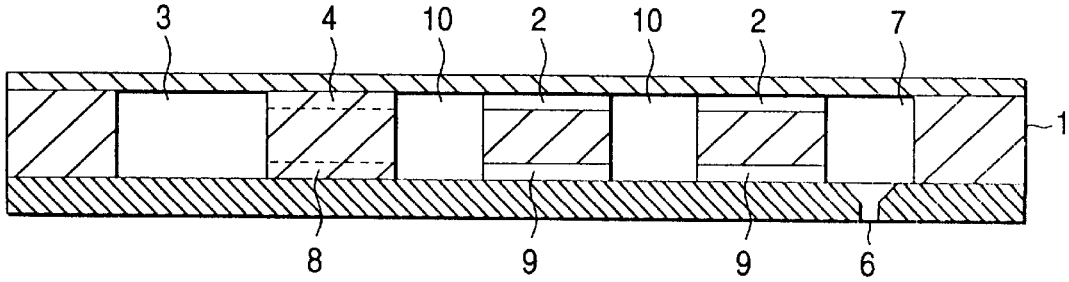

FIGS. 1(A) and 1(B) are sectional views showing a structure of an ink-jet recording head constructed according to the present invention, the structure being illustrated while being cut along the center line of juxtaposed pressure generating chambers contained therein. In FIGS. 1(A) and 1(B), reference numeral 1 denotes a passage forming substrate; 2 denotes a first pressure generating chamber; and 3 denotes a reservoir. Shallow concavities are formed in one of the major surfaces of the passage forming substrate by a half-etching process, and are used as the first pressure generating chambers 2. The reservoir 3, which is bored as a through-hole, is located on one side of the first pressure generating chambers 2.

Figure 2:
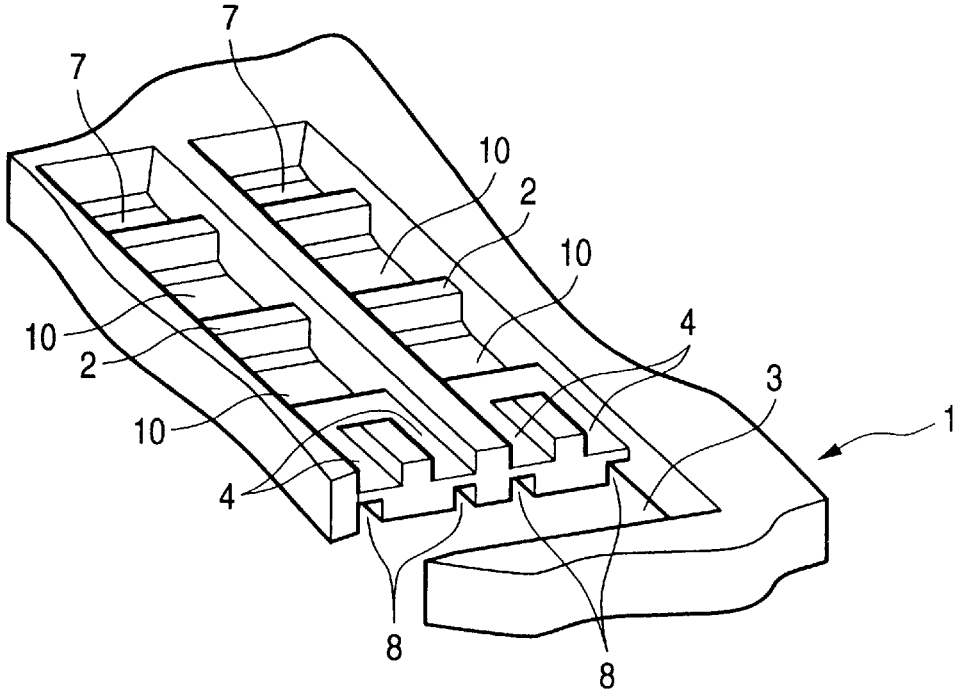
FIGS. 2(A) and 2(B) are perspective views showing the obverse and reverse sides of a passage forming substrate constructed according to the present invention.
Figure 2:
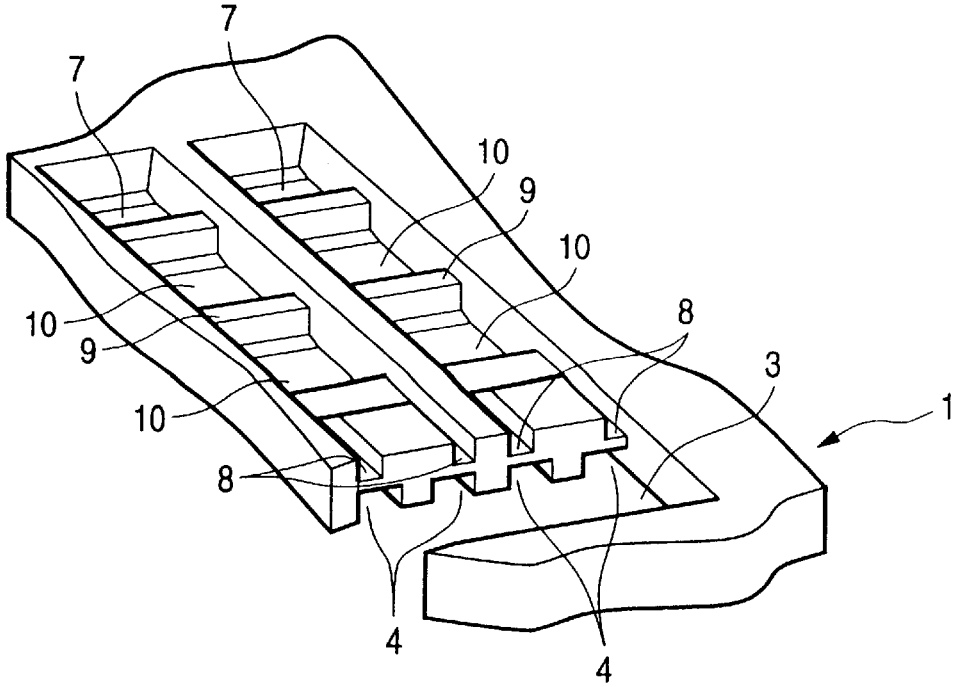

FIGS. 2(A) and 2(B) show an example of a passage forming substrate 1 constructed according to the invention. The obverse and reverse sides of the passage forming substrate 1 are illustrated in FIGS. 2(A) and 2(B), respectively. As shown, first ink supply ports 4 formed as recesses are located between each of the first pressure generating chambers 2 and the reservoir 3. Nozzle passages 7 formed as through-holes are located on the other side of the first pressure generating chambers 2 while being communicated for fluid flow with discharge orifices 6 of a nozzle plate 5 (see FIGS. 1(A) and 1(B)).

Second ink supply ports 8 configured as recesses are formed in the major surface of the passage forming substrate 1, which faces away from the major surface having the first pressure generating chambers 2 formed therein. Second pressure generating chambers 9 configured as cavities like the first pressure generating chambers 2 are also formed in the same major surface of the passage forming substrate 1, while being extended to the discharge orifices 6. The first pressure generating chambers 2 and the second pressure generating chambers 9 are fluidly connected to each other.

The first pressure generating chambers 2 are varied in their volume when receiving displacements from piezoelectric transducing elements 12 (see FIG. 1(A)), respectively. The first ink supply ports 4 interconnect the first pressure generating chambers 2 and the reservoir 3. When the first ink supply ports 4 are compared with the second ink supply ports 8, a flow resistance of the first ink supply ports 4 is smaller than that of the second ink supply ports 8. To this end, in the present embodiment, an area of the cross section of each of the second ink supply ports 8 obtained when the passage forming substrate 1 is vertically cut is smaller than that of each of the first ink supply ports 4.

Generally, a flow resistance of a passage which is rectangular in cross section is proportional to the length of the passage, inversely proportional to the length of the longer side of the cross section of the passage and inversely proportional to the third power of the shorter side of the cross section. A flow resistance of a passage which is circular in cross section is proportional to the length of the passage and inversely proportional to the fourth power of the diameter of the cross section of the passage.

The passage forming substrate 1 may be manufactured by anisotropically etching a silicon monocrystalline substrate to form cavities and through-holes therein or by etching a metal plate of stainless steel to form cavities and through-holes therein.

One side of the thus formed passage forming substrate 1, which includes the first pressure generating chambers 2, is sealed with an elastic plate 11 (see FIG. 1(A)). Islands 11*a* are formed on the elastic plate 11. The tips of the piezoelectric transducing elements 12 are abutted against the central parts of the islands 11*a* of the elastic plate 11, respectively. The piezoelectric transducing elements 12 are of the vertical vibration mode type, and serve as pressure generating means. The other ends of the piezoelectric transducing elements 12 are fastened to a frame, not shown. Each piezoelectric transducing element 12, when alternately expanding and contracting, elastically deforms the elastic plate 11. In the embodiment thus constructed, when the piezoelectric transducing element 12 is charged by applying a drive signal thereto, the piezoelectric transducing element 12 contracts and the first pressure generating chamber 2 associated therewith is expanded in its volume. As a result, ink flows from the reservoir 3 through the related first ink supply ports 4 into the expanded first pressure generating chamber 2, and the ink also flows into the second ink supply ports 8 and through the second ink supply ports 8. Therefore, a sufficient amount of ink, enough to print, can be supplied to the first pressure generating chamber 2 and the second pressure generating chamber 9. In this case, it never happens that the meniscus of ink is retracted from the discharge orifice 6 to such a degree as to adversely affect the ejection of ink drops.

When the piezoelectric transducing element 12 is discharged, it expands to return to its original size and hence the volume of the first pressure generating chamber 2 is reduced. As a result, the ink within the first pressure generating chamber 2 and the second pressure generating chamber 9 is pressurized, and forcibly discharged in the form of an ink drop through the nozzle passage 7 and the corresponding discharge orifice 6.

When such a printing operation is repeated a number of times, and air bubbles attach to the discharge orifice 6 or air bubbles are increased within the first pressure generating chamber 2 and the second pressure generating chamber 9, the ink drops are forcibly purged out of the discharge orifice 6 by applying a capping member to the nozzle plate 5 and a negative pressure to the discharge orifice 6 by means of a suction pump.

The flow resistance of the first ink supply ports 4 is smaller than that of the second ink supply ports 8, as noted above. Therefore, the flow velocity of the ink flowing into the first pressure generating chamber 2 is higher than that of the ink flowing into the second pressure generating chambers 9, and the ink also flows into the second pressure generating chambers 9 through ink supplying passages 10. With the flow of ink, air bubbles that remain in the first pressure generating chamber 2, first ink supply ports 4, and ink supplying passages 10 flow into the second pressure generating chambers 9, and are gathered at and near to the discharge orifice 6. Accordingly, the bubbles, together with the ink, are readily discharged through the discharge orifice 6.

A method of manufacturing the passage forming substrate 1 mentioned above will be described with reference to FIGS. 3(I) to 3(IV) and 4(I') to 4(III). A silicon monocrystalline substrate 21 is prepared, which has a face and a thickness suitable for its handling, e.g., about 300 to 600 $\mu$m. A silicon oxide film 22, which will serve as an etching protecting film, is formed to a thickness of 1 $\mu$m thick over the entire surface of the silicon monocrystalline substrate 21 by thermal oxidation. The portions of the silicon oxide film 22, which are located on the upper and lower sides of the silicon monocrystalline substrate 21, are coated with photoresist by, for example, a spin coating method, to thereby form photoresist layers 23 and 24 thereon. Resist patterns 25, 25', 26, 26', and 27, 27' where the reservoir 3, nozzle passages 7, and ink supplying passage 10 are to be formed, are patterned on the upper and lower photoresist layers 23 and 24 (FIG. 3(I)).

Figure 3:
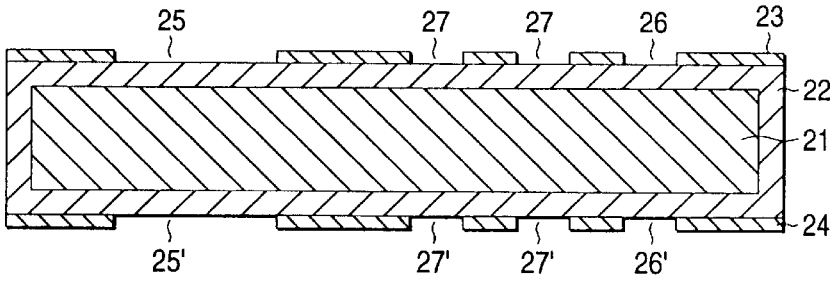
Figure 3:
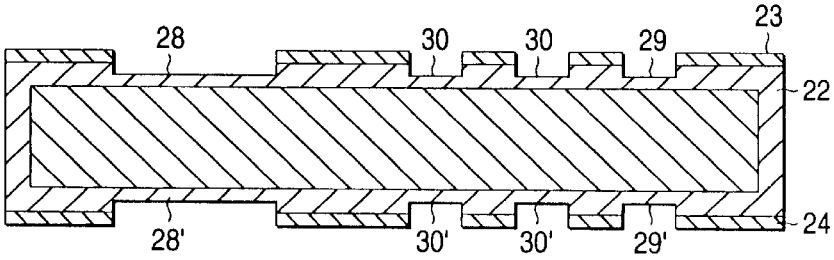
Figure 3:
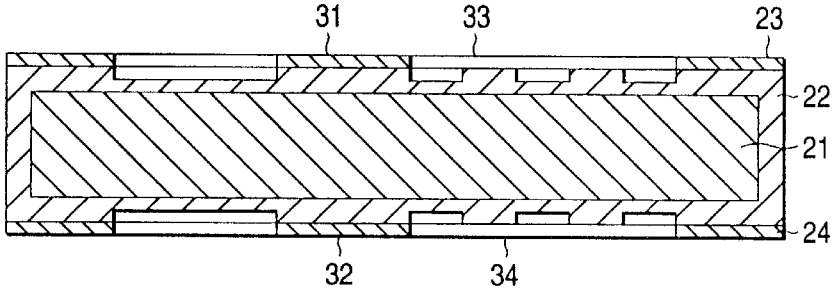
Figure 3:
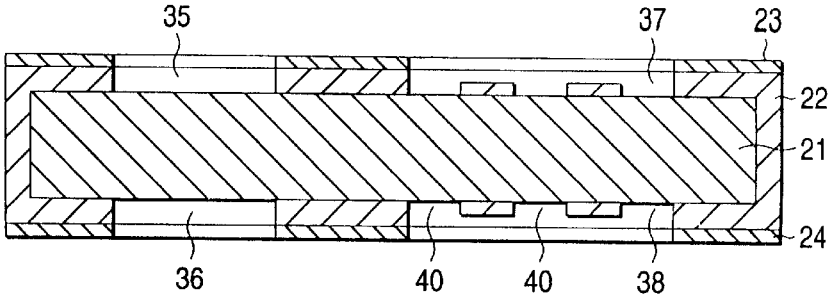

The silicon monocrystalline substrate thus structured is immersed into a buffer hydrofluoric acid solution, whereby the silicon oxide film 22 is half-etched to form patterns 28, 28', 29, 29', and 30, 30', which correspond to resist patterns 25, 25', 26, 26', and 27, 27' (FIG. 3(II)).

The regions where the first and second pressure generating chambers 2 and 9 and the first and second ink supply ports 4 and 8 are to be formed are exposed to light and developed to form patterns 31, 32 and 33 and 34 on both sides of the thus structured silicon monocrystalline substrate 21 (FIG. 3(III)). The silicon monocrystalline substrate 21 is immersed again into the buffer hydrofluoric acid solution, and the etching process is continued until the patterns (of the silicon oxide films) 28, 28', 29, 29' and 30, 30' formed in the step (FIG. 3(II)) disappear (FIG. 3(VI)). As the result of the etching process, the silicon oxide patterns for the first and second pressure generating chambers 2 and 9 and the first and second ink supply ports 4 and 8, which are to be half-etched, are partially left, whereby forming patterns 35, 36, 37, 38 and 40 to be anisotropically etched for forming through-holes of the reservoir 3, nozzle passages 7, and ink supplying passages 10 are formed on both sides of the structure.

Then, the silicon monocrystalline substrate 21 is anisotropically etched in a 20 wt % potassium hydroxide (KOH) solution kept at a temperature of about 80° C. As a result, through-holes 41, 42 and 43 that will serve as the reservoir 3, nozzle passages 7, and ink supplying passages 10 are formed in the structure (FIG. 4(I)).

Then, recess patterns 44, 45, 46 and 47, which will be used as the first and second ink supply ports 4 and 8 and the first and second pressure generating chambers 2 and 9, are formed (FIG. 4(II)), and those patterns are anisotropically etched until those recess patterns have depths suitable for the first and second ink supply ports 4 and 8 and the first and second pressure generating chambers 2 and 9 (FIG. 4(III)). Finally, the silicon oxide film 22 is etched away to complete a passage forming substrate.

In the manufacturing method mentioned above, only the etching process is used for forming the through-holes 41, 42 and 43, which are to be used as the reservoir 3, nozzle passages 7, and ink supplying passages 10. In a modification of the above-described embodiment, through-holes 52 having small diameters may be formed as guide holes by use of a YAG laser before the etching operation is performed as shown in FIG. 4(I'). Formation of the through-holes 52 entails the minimization of the etching areas.

Figure 5:
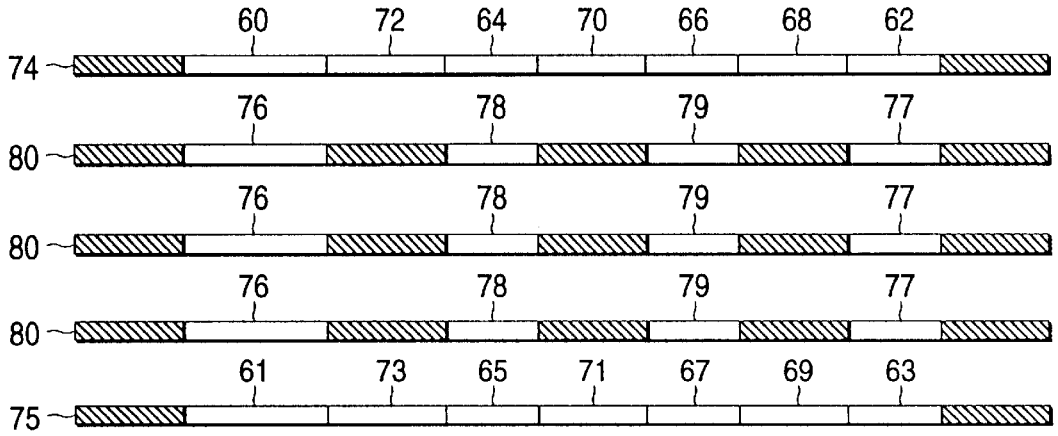
Figure 5:
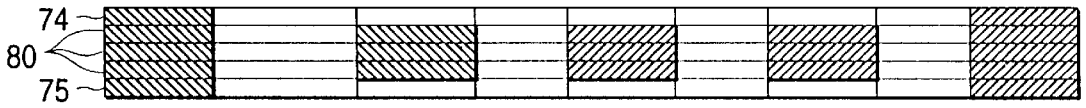

In the above-mentioned embodiment, to form the passage forming substrate 1, recesses and through-holes are formed in a single plate-like member by an etching process. The embodiment may be modified such that at least three layers make up the passage forming substrate 1. A specific example of this modification is shown in FIG. 5(I). As shown, the passage forming substrate 1 consists of five layers or films 74, 75 and 80. Through-holes 60 to 67 and 68 to 73, which are for the reservoir 3, nozzle passages 7 and ink supplying passages 10, and the first and second pressure generating chambers 2 and 9, the first and second ink supply ports 4 and 8, are formed in the films 74 and 75. Through-holes 76 to 79, which are located in the regions for the reservoir 3, nozzle passages 7 and ink supplying passages 10, are formed in the films 80. The films 74, 75 and 80 are layered and bonded together as shown in FIG. 5(II). A photosensitive dry film is preferably used for those films. This film has the following advantages. Through-holes of desired shapes may readily be formed with high precision by the combination of exposing and etching processes. Further, the films are bonded together well since the film has a self-bonding function.

Figure 6:
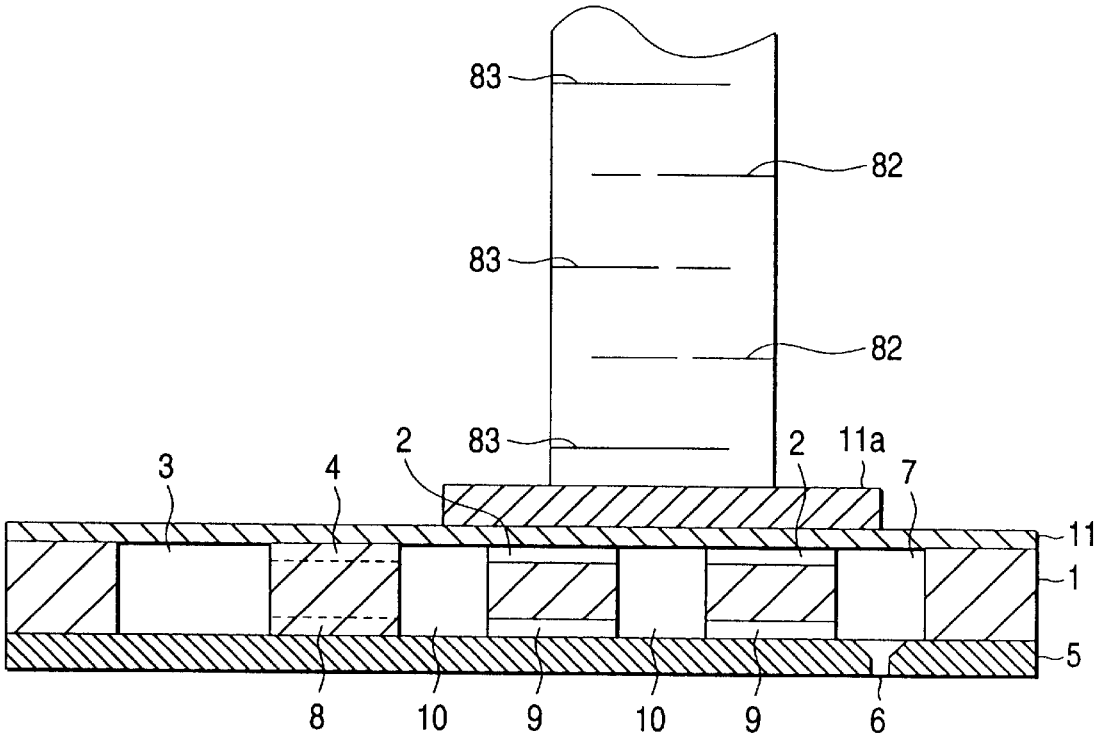
FIGS. 6(*a*) and 6(*b*) are sectional views showing other piezoelectric transducing elements which are applicable for a pressure generating means of an ink-jet recording head of the present invention.
Figure 6:
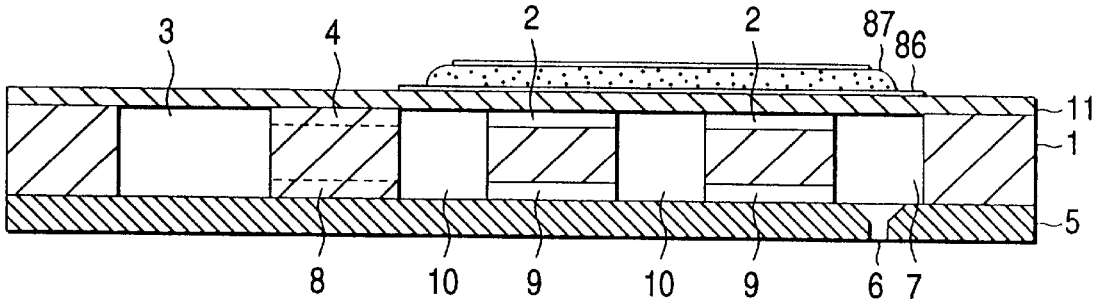

The piezoelectric transducing element used in the above-mentioned embodiment has a piezoelectric constant d31 and a multi-layered structure containing the internal electrodes and the piezoelectric layers, which are layered while being extended in the axial direction. A piezoelectric transducing element having a piezoelectric constant d33 having a multi-layered structure containing internal electrodes 82 and 83 and piezoelectric layers are layered while being extended at right angles to the axial direction, as shown in FIG. 6(*a*), may also be used for the recording head of the present invention.

The piezoelectric transducing element used in the embodiment mentioned above pressurizes in the direction at a right angle to the elastic plate 11. Another type of piezoelectric transducing element may be applied to the recording head of the invention as shown in FIG. 6(*b*). As shown, a lower electrode 86 is formed on the surface of the elastic plate 11 (if the elastic plate is made of non-conductive material), the locations on the lower electrode that correspond to the first pressure generating chambers 2 are coated with piezoelectric material by sputtering or green sheets of piezoelectric material are bonded onto those locations. In FIG. 6(*b*), the coated or bonded piezoelectric layers are designated by numeral 87. In operation, a proper voltage is selectively applied to the piezoelectric layers, so that those layers are flexurally displaced and to pressurize the pressure generating chambers associated therewith.

According to the present invention, first pressure generating chambers and second pressure generating chambers which communicate with a reservoir through first ink supply ports and second ink supply ports are formed on both sides of a passage forming substrate. The first ink supply ports are formed on one side of the passage forming substrate that contains a discharge orifice, and the second ink supply ports are formed on the other side of the passage forming substrate that faces an elastic plate. A flow resistance of each of the second ink supply ports is larger than that of each of the first ink supply ports, whereby ink also flows into the second pressure generating chambers located closer to a nozzle plate through the ink supplying passages. With such a structure, air bubbles remaining in the first pressure generating chambers, which are formed on the surface of the ink passage forming substrate that faces a piezoelectric transducing element, easily move to the second pressure generating chambers located closer to the discharge orifice which serves as an ink discharging port, and can readily be discharged out of the recording head at the time of maintenance.

It is contemplated that numerous modifications may be made to the ink-jet recording apparatus of the present invention without departing from the spirit and scope of the invention as defined in the following claims.

What is claimed is:

1. An ink-jet recording head having a passage forming substrate which defines pressure generating chambers and contains a reservoir, ink supply ports, and nozzle passages as through-holes; a nozzle plate having a nozzle orifice communicating with said pressure generating chambers through said nozzle passages; an elastic plate sealingly covering one of the surfaces of said passage forming substrate, and a pressure generating device which pressurizes said pressure generating chambers, said ink-jet recording head comprising:

first ink supply ports formed on the one surface of said passage forming substrate which faces said elastic plate;

second ink supply ports formed on another of the surfaces of said passage forming substrate which faces said nozzle plate; and first and second pressure generating chambers communicating with said reservoir through said first and second ink supply ports;

wherein a flow resistance of each of said first ink supply ports is smaller than that of each of said second ink supply ports.

2. The ink-jet recording head according to claim 1, wherein said first and second pressure generating chambers communicate with each other by way of at least one nozzle passage.

3. The ink-jet recording head according to claim 1, wherein said passage forming substrate comprises a silicon monocrystalline substrate anisotropically etched.

4. The ink-jet recording head according to claim 1, wherein said passage forming substrate comprises a silicon monocrystalline substrate of 300 $\mu$m to 600 $\mu$m thick.

5. The ink-jet recording head according to claim 1, wherein said passage forming substrate comprises at least three plate-like members layered one on another, each of said plate-like members having its own array of through-holes.

6. The ink-jet recording head according to claim 5, wherein each of said plate-like members comprises a photosensitive dry film.

7. The ink-jet recording head according to claim 1, wherein said pressure generating device comprises a piezoelectric transducing element that expands and contracts in an axial direction.

8. The ink-jet recording head according to claim 1, wherein said pressure generating device comprises a piezoelectric transducing element that flexurally displaces.

9. An ink-jet recording head having a passage forming substrate which defines pressure generating chambers formed as recesses and contains a reservoir, ink supply ports, and nozzle passages as through-holes; a nozzle plate having a nozzle orifice communicating with said pressure generating chambers through said nozzle passages; an elastic plate sealingly covering one of the surfaces of said passage forming substrate, and a pressure generating device which pressurizes said pressure generating chambers, said ink-jet recording head comprising:

first ink supply ports formed on the one surface of said passage forming substrate which faces said elastic plate;

second ink supply ports formed on another of the surfaces of said passage forming substrate which faces said nozzle plate; and first and second pressure generating chambers communicating with said reservoir through said first and second ink supply ports;

wherein a cross sectional area of each of said first ink supply ports is larger than that of each of said second ink supply ports.

10. The ink-jet recording head according to claim 9, wherein each of said first ink supply ports has a depth which is substantially equal to that of each of said second ink supply ports.

11. The ink-jet recording head according to claim 9, wherein said first and second ink supply ports have a depth which is substantially equal to that of said first and second pressure generating chambers.

12. The ink-jet recording head according to claim 9, wherein said first and second pressure generating chambers communicate with each other by way of at least one nozzle passage.

13. The ink-jet recording head according to claim 9, wherein said passage forming substrate comprises a silicon monocrystalline substrate anisotropically etched.

14. The ink-jet recording head according to claim 9, wherein said passage forming substrate comprises a silicon monocrystalline substrate of 300 $\mu$m to 600 $\mu$m thick.

15. The ink-jet recording head according to claim 9, wherein said passage forming substrate comprises at least three plate-like members layered one on another, each of said plate-like members having its own array of through-holes.

16. The ink-jet recording head according to claim 15, wherein each of said plate-like members comprises a photosensitive dry film.

17. The ink-jet recording head according to claim 9, wherein said pressure generating device comprises a piezoelectric transducing element that expands and contracts in an axial direction.

18. The ink-jet recording head according to claim 9, wherein said pressure generating device comprises a piezoelectric transducing element that flexurally displaces.

* * * * *